US011773758B2

(12) United States Patent
Hisano et al.

(10) Patent No.: US 11,773,758 B2
(45) Date of Patent: Oct. 3, 2023

(54) VARIABLE VALVE MECHANISM

(71) Applicant: Kawasaki Jukogyo Kabushiki Kaisha, Kobe (JP)

(72) Inventors: Atsushi Hisano, Kobe (JP); Youta Sakurai, Kobe (JP); Yoshichika Sato, Kobe (JP); Satoru Takao, Kobe (JP)

(73) Assignee: KAWASAKI JUKOGYO KABUSHIKI KAISHA, Kobe (JP)

( * ) Notice: Subject to any disclaimer, the term of this patent is extended or adjusted under 35 U.S.C. 154(b) by 0 days.

(21) Appl. No.: 17/788,747

(22) PCT Filed: Sep. 24, 2020

(86) PCT No.: PCT/JP2020/035965
§ 371 (c)(1),
(2) Date: Jun. 24, 2022

(87) PCT Pub. No.: WO2021/131190
PCT Pub. Date: Jul. 1, 2021

(65) Prior Publication Data

US 2023/0025775 A1 Jan. 26, 2023

(30) Foreign Application Priority Data

Dec. 25, 2019 (JP) ..... 2019-234730

(51) Int. Cl.
*F01L 13/00* (2006.01)
*F01L 1/46* (2006.01)
(Continued)

(52) U.S. Cl.
CPC ..... *F01L 13/0063* (2013.01); *F01L 1/185* (2013.01); *F01L 1/46* (2013.01); *F02D 13/0207* (2013.01);
(Continued)

(58) Field of Classification Search
CPC ... F01L 1/053; F01L 1/185; F01L 1/46; F01L 13/0063; F02D 13/0207; F02D 2013/0296
(Continued)

(56) References Cited

U.S. PATENT DOCUMENTS 8,813,696 B2 * 8/2014 Choi ..... F01L 13/0005 123/90.11
9,732,639 B1 * 8/2017 Dike ..... F01L 1/053
(Continued)

FOREIGN PATENT DOCUMENTS

CN 106837465 A * 6/2017
CN 110173320 A * 8/2019
(Continued)

*Primary Examiner* — Jorge L Leon, Jr.
(74) *Attorney, Agent, or Firm* — XSENSUS LLP

(57) ABSTRACT

A variable valve mechanism includes a cam that rotates about a rotating shaft in association with rotation of a crank shaft of an engine, a swinging arm that is disposed between the cam and a valve and is pushed by the rotating cam to swing and push the valve by a first end portion of the swinging arm, and a moving device that moves a second end portion of the swinging arm. Further, there is a regulating member that is coupled to the first end portion of the swinging arm so as to be rotatable and regulates displacement of the first end portion of the swinging arm relative to the valve when the second end portion of the swinging arm is moved by the moving device. The mechanism further includes a connection member that connects the second end portion of the swinging arm to the moving device.

6 Claims, 7 Drawing Sheets

(51) Int. Cl.
*F02D 13/02* (2006.01)
*F01L 1/18* (2006.01)
*F01L 1/053* (2006.01)

(52) U.S. Cl.
CPC ..... *F01L 1/053* (2013.01); *F02D 2013/0296* (2013.01)

(58) Field of Classification Search
USPC ..... 123/90.16, 90.41, 90.44
See application file for complete search history.

(56) References Cited

U.S. PATENT DOCUMENTS

2015/0013627 A1* 1/2015 Nunami ..... F01L 1/22
123/90.16
2016/0138437 A1* 5/2016 Lee ..... F01L 1/047
123/90.12

FOREIGN PATENT DOCUMENTS

DE 102011116439 A1 * 4/2013 ..... F01L 13/0026
JP 3-5906 A 1/1991

* cited by examiner

VARIABLE VALVE MECHANISM

CROSS-REFERENCE TO RELATED APPLICATIONS

The present application is based on PCT filing PCT/JP2020/035965, filed Sep. 24, 2020, which claims priority to JP 2019-234730, filed Dec. 25, 2019, the entire contents of each are incorporated herein by reference.

TECHNICAL FIELD

The present invention relates to a variable valve mechanism of an engine.

BACKGROUND ART

Conventionally proposed is a variable valve mechanism that changes lift characteristics of a valve that opens or closes an intake port or an exhaust port of an engine, i.e., changes open/close timings, open/close amounts, and the like of the valve.

For example, PTL 1 discloses a variable valve mechanism of an internal combustion engine including a control cam that moves a swinging arm (rocker arm) disposed between a drive cam and a valve stem. The control cam is disposed at a base end of the swinging arm so as to be rotatable, and a fulcrum portion of the base end of the swinging arm is rotatably attached to a portion of the control cam which portion is located away from a rotational center of the control cam. A tip portion of the swinging arm is in contact with a cap disposed at an upper end of the valve stem. The control cam is rotated by a driving unit by a predetermined angle. When the driving unit rotates the control cam by the predetermined angle, the position of the swinging arm relative to the drive cam changes. As a result, a position where the swinging arm and the drive cam contact each other changes, and therefore, a valve timing and a valve lift amount change.

CITATION LIST

Patent Literature

PTL 1: Japanese Laid-Open Utility Model Application Publication No. 3-5906

SUMMARY OF INVENTION

Technical Problem

According to the above-described variable valve mechanism, when the control cam is rotated in order to change the lift characteristics of the valve, the tip portion of the swinging arm moves in a direction intersecting with a valve axis. At this time, the tip portion of the swinging arm moves along an upper surface of the cap disposed at the upper end of the valve stem. To suppress abrasion of the portion where the tip portion of the swinging arm and the valve contact each other, the tip portion of the swinging arm is desired not to be displaced relative to the valve as much as possible when the swinging arm moves in order to change the lift characteristics.

An object of the present invention is to provide a variable valve mechanism of an engine, the variable valve mechanism being able to suppress displacement of a swinging arm relative to a valve when the swinging arm moves in order to change lift characteristics.

Solution to Problem

In order to solve the above problems, a variable valve mechanism according to one aspect of the present invention is a variable valve mechanism that changes a lift characteristic of a valve that opens or closes an intake port or an exhaust port of an engine. The variable valve mechanism includes: a cam that rotates about a rotating shaft in association with rotation of a crank shaft of the engine; a swinging arm that is disposed between the cam and the valve and is pushed by the rotating cam to swing and push the valve by a first end portion of the swinging arm; a moving device that moves a second end portion of the swinging arm; a regulating member that is coupled to the first end portion of the swinging arm so as to be rotatable about a swinging shaft parallel to the rotating shaft and regulates displacement of the first end portion of the swinging arm relative to the valve when the second end portion of the swinging arm is moved by the moving device, and a connection member that connects the second end portion of the swinging arm to the moving device such that when the second end portion of the swinging arm is moved by the moving device, movement of the second end portion of the swinging arm about the swinging shaft is allowed.

According to the above configuration, when the second end portion of the swinging arm is moved by the moving device, the regulating member regulates the displacement of the first end portion of the swinging arm relative to the valve. Moreover, the connection member connects the second end portion of the swinging arm to the moving device such that when the second end portion of the swinging arm is moved by the moving device, the movement of the second end portion of the swinging arm about the swinging shaft is allowed. Therefore, the displacement of the swinging arm relative to the valve can be suppressed when moving the swinging arm in order to change the lift characteristics.

Advantageous Effects of Invention

The present invention can provide a variable valve mechanism of an engine, the variable valve mechanism being able to suppress displacement of a swinging arm relative to a valve when moving the swinging arm in order to change lift characteristics.

DESCRIPTION OF EMBODIMENTS

Figure 1:
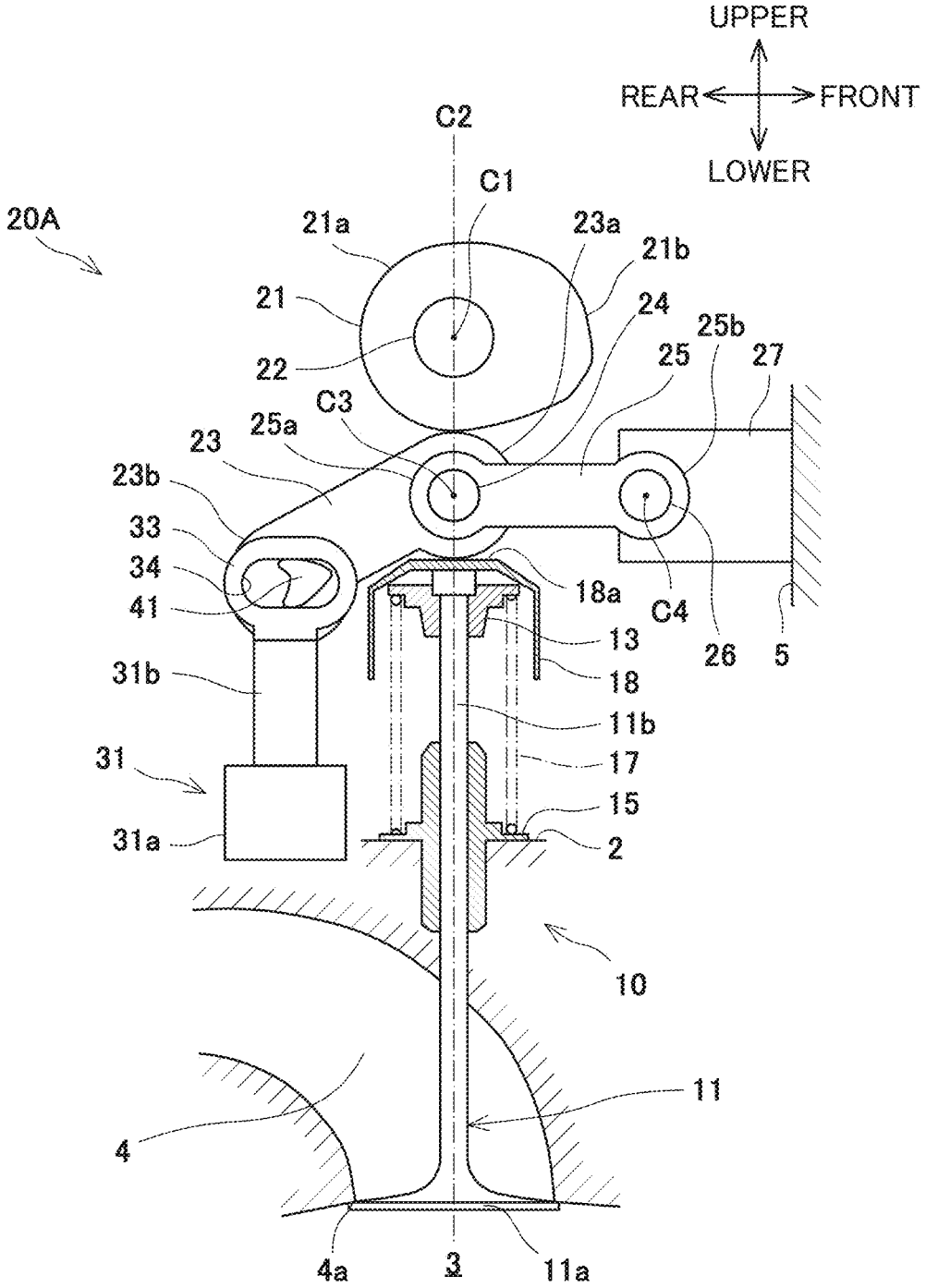
FIG. 1 is a schematic sectional view showing a variable valve mechanism of an engine according to Embodiment 1 and its vicinity.

Hereinafter, preferred embodiments of the present invention will be described with reference to the drawings. In the drawings, the same reference signs are used for the same or corresponding components, and the repetition of the same explanation is avoided.

Embodiment 1

FIG. 1 is a schematic sectional view showing an intake-side variable valve mechanism 20A of an engine according to Embodiment 1. First, the configuration of the engine that adopts the variable valve mechanism 20A according to Embodiment 1 will be described.

The engine described in the present embodiment is a double overhead camshaft (DOHC) engine. An intake port 4 and an exhaust port (not shown) which communicate with a combustion chamber 3 are disposed at a cylinder head 2 of the engine. Moreover, an intake valve 10 which opens or closes the combustion chamber 3 with respect to the intake port 4 and an exhaust valve (not shown) which opens or closes the combustion chamber 3 with respect to the exhaust port are disposed at the cylinder head 2. The engine includes: the intake-side variable valve mechanism 20A that opens or closes the intake valve 10; and an exhaust-side variable valve mechanism that opens or closes the exhaust valve.

Such engine is mounted on, for example, a motorcycle. Hereinafter, for convenience of explanation, the concept of directions mentioned in the embodiments is substantially based on a rider of the motorcycle on which the engine is mounted. Specifically, a paper surface upper side in FIG. 1 is defined as an "upper side" of the engine, and a paper surface lower side in FIG. 1 is defined as a "lower side" of the engine. A paper surface right side in FIG. 1 is defined as a "front side" of the engine, and a paper surface left side in FIG. 1 is defined as a "rear side" of the engine. A paper surface deep side in FIG. 1 is defined as a "left side" of the engine, and a paper surface near side in FIG. 1 is defined as a "right side" of the engine. A lower direction in the concept of directions in the embodiments defined as above does not have to coincide with a vertically lower direction and may be inclined with respect to the vertically lower direction at an angle of less than 90 degrees. For example, a below-described valve axis C2 may be inclined with respect to a vertical direction.

The valve 10 at the intake side and the valve at the exhaust side are substantially the same in structure as each other, and the variable valve mechanism 20A at the intake side and the variable valve mechanism at the exhaust side are substantially the same in structure as each other. Therefore, hereinafter, the valve 10 at the intake side and the variable valve mechanism 20A at the intake side will be mainly described. In addition, hereinafter, the "intake valve 10" and the "intake port 4" are simply referred to as a "valve 10" and a "port 4."

The valve 10 includes a valve main body 11. The valve main body 11 includes: a flange portion 11*a* that opens or closes the port 4; and a stem portion 11*b* that extends upward from the flange portion 11*a*. A spring retainer 13 is attached to an upper end portion of the stem portion 11*b* through a cotter (not shown). A spring seat 15 is attached to an upper surface of the cylinder head 2. A valve spring 17 is interposed between the spring seat 15 and the spring retainer 13. The valve main body 11 is biased upward by the valve spring 17. With this, the flange portion 11*a* is brought into contact with a peripheral portion (valve seat) 4*a* of the port 4 to close the port 4.

A tappet 18 is attached to an upper end of the stem portion 11*b* through a shim (not shown). When the variable valve mechanism 20A pushes down the tappet 18, the flange portion 11*a* separates from the valve seat 4*a* to open the port 4.

The variable valve mechanism 20A changes lift characteristics of the valve 10. Specifically, the variable valve mechanism 20A changes a maximum lift amount, open/close timings, and an open time of the valve 10. The variable valve mechanism 20A includes a cam 21, a swinging arm 23, a regulating arm (regulating member) 25, a moving device 31, and a connection member 33.

The cam 21 rotates in association with the rotation of a crank shaft (not shown) of the engine. Specifically, a camshaft 22 (rotating shaft) to which the cam 21 is fixed is arranged above the valve 10. The camshaft 22 extends horizontally in the left-right direction. The camshaft 22 is connected to the crank shaft through a rotation transmission mechanism (not shown), such as a chain, and rotates in association with the crank shaft. Thus, the cam 21 fixed to the camshaft 22 rotates together with the camshaft 22.

In the present embodiment, the camshaft 22 is orthogonal to the axis C2 of the valve 10 (i.e., orthogonal to a straight line obtained by extending a center line of the stem portion 11*b*). To be specific, an axis C1 of the camshaft 22 is located on the axis C2 of the valve 10 when viewed from a direction along the axis C1. However, the axis C1 of the camshaft 22 does not have to be located on the axis C2 of the valve 10 when viewed from the direction along the axis C1. The axis C1 may be located in front of or behind the axis C2 of the valve 10.

An outer peripheral surface of the cam 21 around the axis C1 includes a base circle 21*a* and a cam nose 21*b*. The base circle 21*a* has a perfect circle shape located away from the axis C1 of the camshaft 22 by a certain distance. The cam nose 21*b* bulges outward in a radial direction from the base circle 21*a*.

The swinging arm 23 is disposed between the cam 21 and the valve 10. The swinging arm 23 extends in a direction orthogonal to a direction parallel to the axis C1 of the camshaft 22 (i.e., in a direction perpendicular to the axis C1). When the swinging arm 23 is pushed by the rotating cam 21, the swinging arm 23 swings so as to change an extending direction of the swinging arm 23 relative to the axis C2 of the valve 10 when viewed from the direction along the axis C1.

The swinging arm 23 is arranged such that a first end portion 23*a* of the swinging arm 23 is in contact with the cam 21 and the tappet 18. Specifically, the outer peripheral surface (at least the cam nose 21*b*) of the cam 21 is in contact with an upper surface of the first end portion 23*a*, and an upper surface (tappet surface) 18*a* of the tappet 18 is in contact with a lower surface of the first end portion 23*a*. The upper surface 18*a* of the tappet 18 is a surface orthogonal to the valve axis C2. A second end portion 23*b* of the swinging arm 23 is located behind the first end portion 23*a*, i.e., the second end portion 23*b* located at an opposite side of the first end portion 23*a* in the extending direction of the swinging arm 23 is located behind the first end portion 23*a*.

A first end portion 25*a* of the regulating arm 25 is coupled to the first end portion 23*a* of the swinging arm 23. More specifically, the first end portion 23*a* of the swinging arm 23 and the first end portion 25*a* of the regulating arm 25 are coupled to each other so as to be rotatable relative to each other by a first swinging shaft 24 extending in parallel with the axis C1 of the camshaft 22. When viewed from the direction along the axis C1, the first swinging shaft 24 is located on the axis C2 of the valve 10.

The first end portion 23*a* of the swinging arm 23 includes a peripheral surface having a circular shape whose center is an axis C3 of the first swinging shaft 24 when viewed from the direction along the axis C1. The circular peripheral surface is smoothly connected to an upper surface of an extending portion of the swinging arm 23 which portion extends linearly in the extending direction of the swinging arm 23 when viewed from the direction along the axis C1. The first end portion 25*a* of the regulating arm 25 includes a peripheral surface having a circular shape whose center is the axis C3 of the first swinging shaft 24 and which is smaller in diameter than the first end portion 23*a* when viewed from the direction along the axis C1. However, the shape of the swinging arm 23 and the shape of the regulating arm 25 are not limited to the above shapes. For example, the first end portion 25*a* of the regulating arm 25 may be the same in diameter as or larger in diameter than the first end portion 23*a* of the swinging arm 23 when viewed from the direction along the axis C1. To be specific, the first end portion 25*a* of the regulating arm 25 may be in contact with the outer peripheral surface of the cam 21 and/or the upper surface 18*a* of the tappet 18.

The regulating arm 25 extends in a direction orthogonal to a direction parallel to the axis C1 of the camshaft 22 (i.e., in a direction perpendicular to the axis C1). A second end portion 25*b* of the regulating arm 25 is located in front of the first end portion 25*a*. i.e., the second end portion 25*b* located at an opposite side of the first end portion 25*a* in an extending direction of the regulating arm 25 is located in front of the first end portion 25*a*. However, the regulating arm 25 may extend rearward from the first end portion 25*a* of the swinging arm 23. Moreover, the first swinging shaft 24 may be formed integrally with the swinging arm 23 or the regulating arm 25.

The second end portion 25*b* of the regulating arm 25 is supported by a rotation supporting portion 27 so as to be rotatable about a second swinging shaft 26. The second swinging shaft 26 is parallel to the camshaft 22 and is disposed at a fixed position with respect to the axis C1 of the camshaft 22. To be specific, the axis C3 of the first swinging shaft 24 is displaced relative to the axis C1 of the camshaft 22 by the rotation of the cam 21, but an axis C4 of the second swinging shaft 26 is not displaced relative to the axis C1 of the camshaft 22 regardless of the rotation of the cam 21.

The rotation supporting portion 27 may support the second end portion 25*b* of the regulating arm 25 through the second swinging shaft 26 such that the second swinging shaft 26 is not displaced relative to the axis C1 of the camshaft 22. The rotation supporting portion 27 is, for example, a member attached to any of the cylinder head 2, a cylinder head cover (not shown) attached to an upper portion of the cylinder head 2, and a casing 5 covering the cylinder head 2. The rotation supporting portion 27 may be a separate member from the cylinder head 2, the cylinder head cover, and the casing or may be a part of any of the cylinder head 2, the cylinder head cover, and the casing. The second swinging shaft 26 may be formed integrally with the regulating arm 25 or the rotation supporting portion 27.

As above, the second end portion 25*b* of the regulating arm 25 is supported so as to be rotatable about the second swinging shaft 26 arranged fixedly with respect to the axis C1 of the camshaft 22. Therefore, the regulating arm 25 regulates the displacement of the first end portion 23*a* of the swinging arm 23 relative to the valve 10. More specifically, the regulating arm 25 restricts the movement of the first end portion 23*a* of the swinging arm 23 to the turning about the axis C4.

The moving device 31 and the connection member 33 are located behind the axis C2 of the valve 10. The moving device 31 moves the second end portion 23*b* of the swinging arm 23. Specifically, the moving device 31 positions the second end portion 23*b* of the swinging arm 23 in an extending direction (upper-lower direction) of the axis C2 of the valve 10. The moving device 31 includes: a fixed member 31*a* disposed at a fixed position with respect to the axis C1 of the camshaft 22; and a movable portion 31*b* that is movable (displaceable) relative to the fixed member 31*a*.

For example, the moving device 31 is a linear motion actuator that linearly (for example, the extending direction of the axis C2 of the valve 10) moves the movable portion 31*b* relative to the fixed member 31*a* However, the moving device 31 may be a turning actuator. For example, the moving device 31 is a hydraulic actuator including a hydraulic control valve and a hydraulic cylinder. However, the moving device 31 does not have to be of a hydraulic type, and for example, may be of a mechanical type, a motor type, or an electromagnet type. Moreover, the moving device 31 may include a link mechanism, a worm gear, a rack and pinion, or the like.

The connection member 33 that connects the second end portion 23*b* of the swinging arm 23 to the moving device 31 is disposed at the movable portion 31*b* of the moving device 31. The connection member 33 connects the second end portion 23*b* of the swinging arm 23 to the moving device 31. Specifically, an engaging pin 41 is disposed at the second end portion 23*b* of the swinging arm 23. The connection member 33 includes an insertion hole 34 into which the engaging pin 41 is inserted. The engaging pin 41 extends in parallel with a direction in which the axis C1 of the camshaft 22 extends. The insertion hole 34 is open in the direction (left-right direction) in which the axis C1 of the camshaft 22 extends. When the engaging pin 41 is inserted into and held in the insertion hole 34, the second end portion 23*b* of the swinging arm 23 and the movable portion 31*b* of the moving device 31 are connected to each other.

The connection member 33 connects the second end portion 23*b* of the swinging arm 23 to the moving device 31 such that when the second end portion 23*b* of the swinging arm 23 is moved by the moving device 31, the movement of the second end portion 23*b* of the swinging arm 23 about the axis C3 of the first swinging shaft 24 is allowed. This will be described in more detail with reference to FIG. 2.

Figure 2:
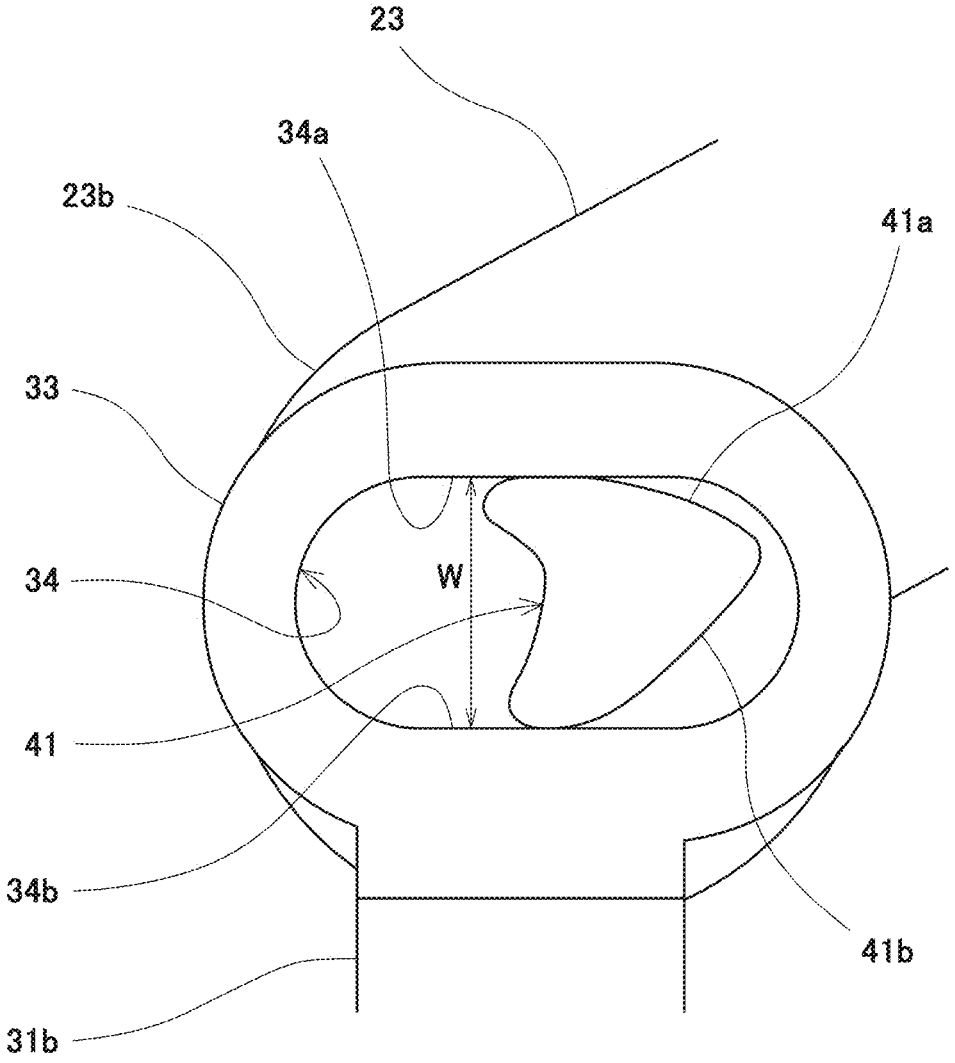
FIG. 2 is an enlarged view showing the vicinity of a connection member shown in FIG. 1.

FIG. 2 is an enlarged view showing the vicinity of the connection member 33. The insertion hole 34 has an elongated hole shape. When viewed from the direction in which the axis C1 of the camshaft 22 extends, a longitudinal direction of the insertion hole 34 is a direction intersecting with the valve axis C2 (see FIG. 1). In the present example, when viewed from the direction in which the axis C1 of the camshaft 22 extends, the longitudinal direction of the insertion hole 34 is orthogonal to the valve axis C2. An inner peripheral surface of the insertion hole 34 when viewed from the direction in which the axis C1 of the camshaft 22 extends includes a first inner peripheral surface portion 34*a* and a second inner peripheral surface portion 34*b* which are opposed to each other in a transverse direction of the insertion hole 34 (in the present example, in a direction along the valve axis C2). The first inner peripheral surface portion 34*a* and the second inner peripheral surface portion 34*b* are flat surface portions parallel to each other.

A section of the engaging pin 41 which section is obtained by cutting the engaging pin 41 in a direction perpendicular to the axis C1 of the camshaft 22 has a substantially heart shape. An outer peripheral surface of the engaging pin 41 includes: a first outer peripheral surface portion 41*a* contacting the first inner peripheral surface portion 34*a*; and a second outer peripheral surface portion 41*b* contacting the second inner peripheral surface portion 34*b*.

As described above, the displacement of the first end portion 23*a* of the swinging arm 23 relative to the valve 10 is regulated by the regulating arm 25. Therefore, when the swinging arm 23 is pushed by the rotating cam 21 or when the second end portion 23*b* of the swinging arm 23 is moved by the moving device 31, the engaging pin 41 rotates in the insertion hole 34 and slides in the longitudinal direction of the insertion hole 34.

Moreover, the engaging pin 41 is formed such that to reduce contact surface pressure between the engaging pin 41 and the inner peripheral surface of the insertion hole 34, each of a curvature radius of the first outer peripheral surface portion 41*a* and a curvature radius of the second outer peripheral surface portion 41*b* when viewed from the direction in which the axis C1 of the camshaft 22 extends is larger than a length that is half a width w of the insertion hole 34 in the transverse direction.

Next, the operation of the variable valve mechanism 20A will be described with reference to FIGS. 3A, 3B, 4A, 4B, and 5.

Figure 3A:
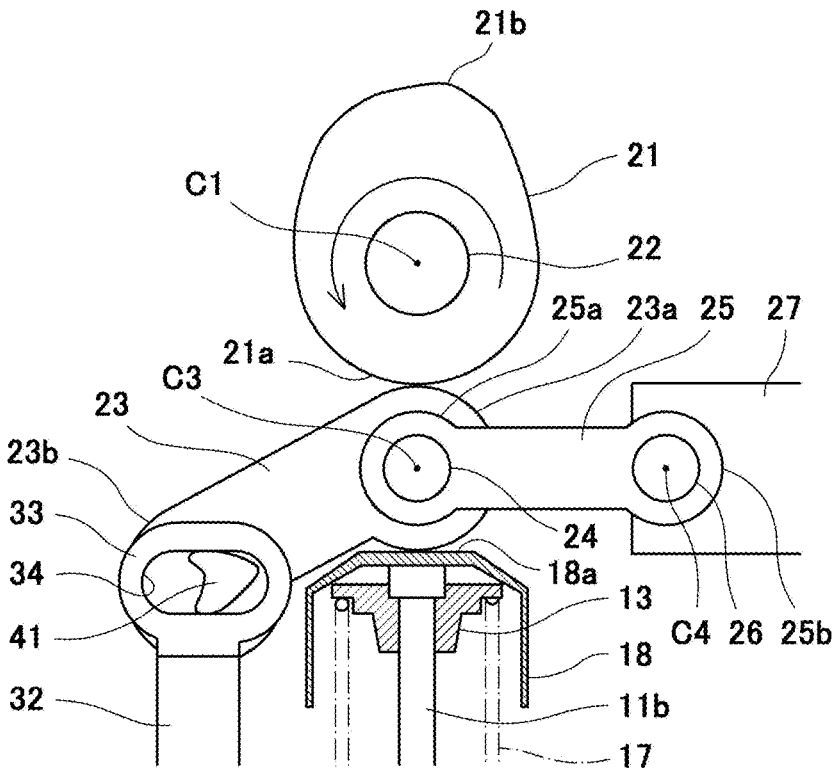
FIG. 3A is a diagram showing an operation performed at the time of low lift of the variable valve mechanism shown in FIG. 1 and shows that a base circle of a cam is located at a position opposed to a swinging arm.
Figure 3B:
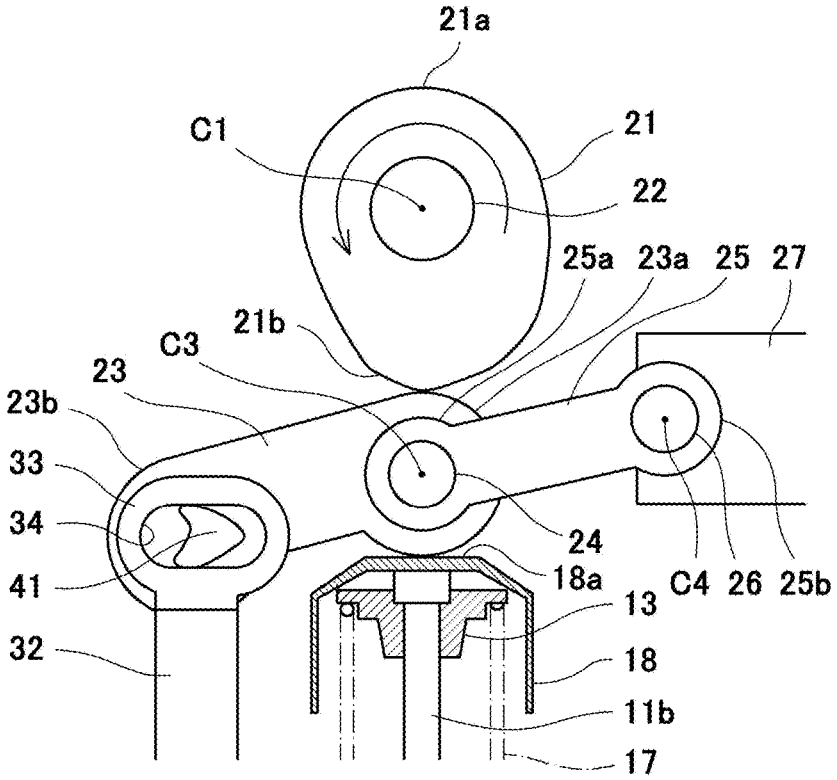
FIG. 3B is a diagram showing an operation performed at the time of the low lift of the variable valve mechanism shown in FIG. 1 and shows that a cam nose of the cam is located at the position opposed to the swinging arm.
Figure 4A:
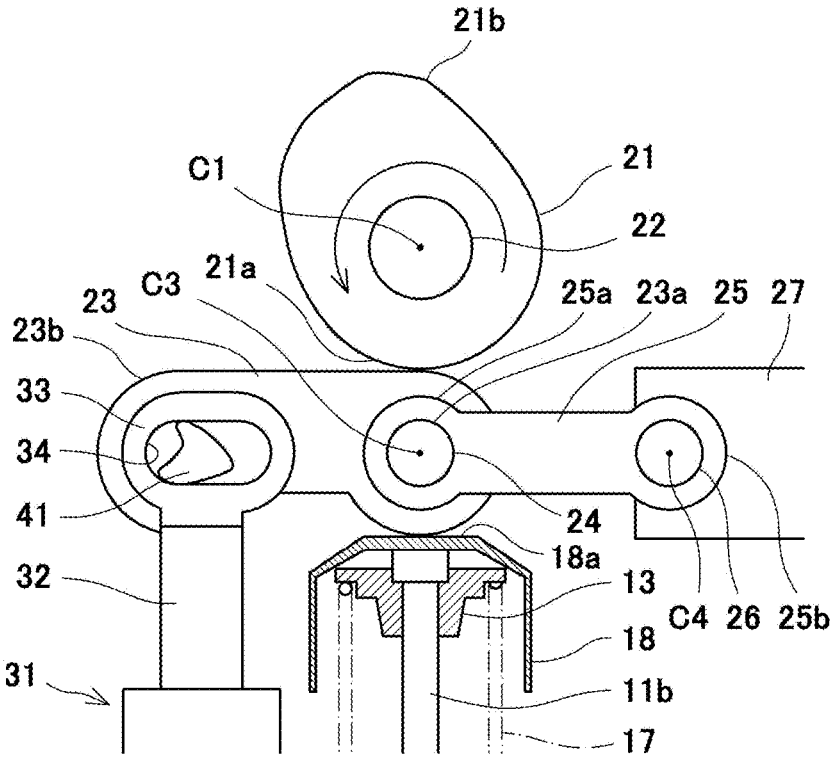
FIG. 4A is a diagram showing an operation performed at the time of high lift of the variable valve mechanism shown in FIG. 1 and shows that the base circle of the cam is located at the position opposed to the swinging arm.
Figure 4B:
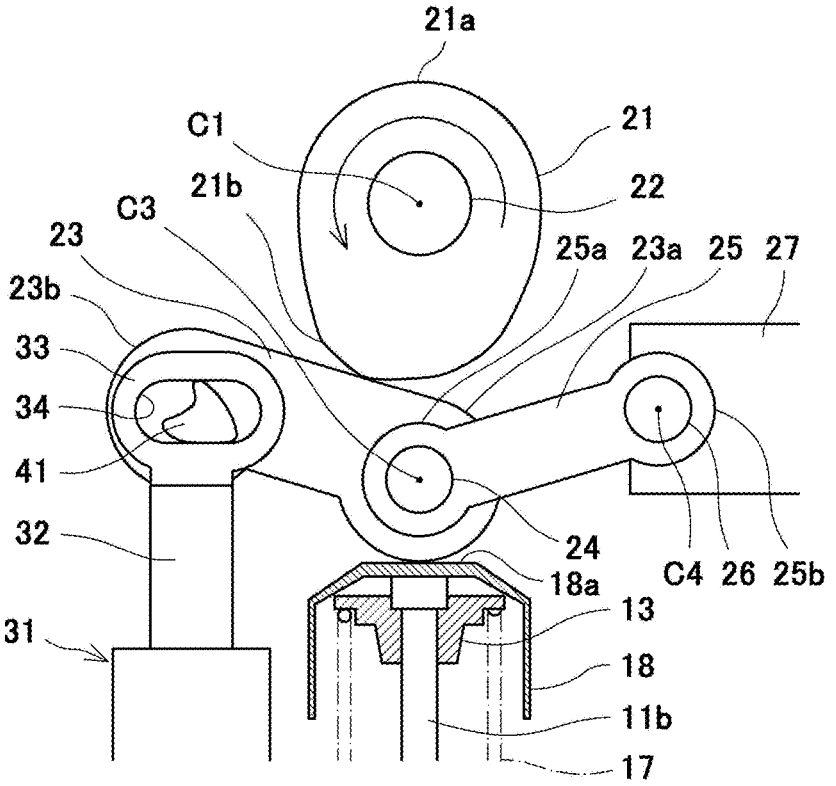
FIG. 4B is a diagram showing an operation performed at the time of the high lift of the variable valve mechanism shown in FIG. 1 and shows that the cam nose of the cam is located at the position opposed to the swinging arm.

FIGS. 3A, 3B, 4A, and 4B show the variable valve mechanisms 20A whose states are different from each other. The variable valve mechanisms 20A shown in FIGS. 3A and 3B and the variable valve mechanisms 20A shown in FIGS. 4A and 4B are different from each other regarding the position of the connection member 33. The states shown in FIGS. 3A and 3B and the states shown in FIGS. 4A and 4B are different from each other regarding the lift characteristics of the valve 10 operated by the variable valve mechanism 20A. Hereinafter, the state of the variable valve mechanism 20A shown in each of FIGS. 3A and 3B is referred to as a low lift state, and the state of the variable valve mechanism 20A shown in each of FIGS. 4A and 4B in which the maximum lift amount of the valve 10 is larger than that in the state shown in each of FIGS. 3A and 3B is referred to as a high lift state.

Figure 5:
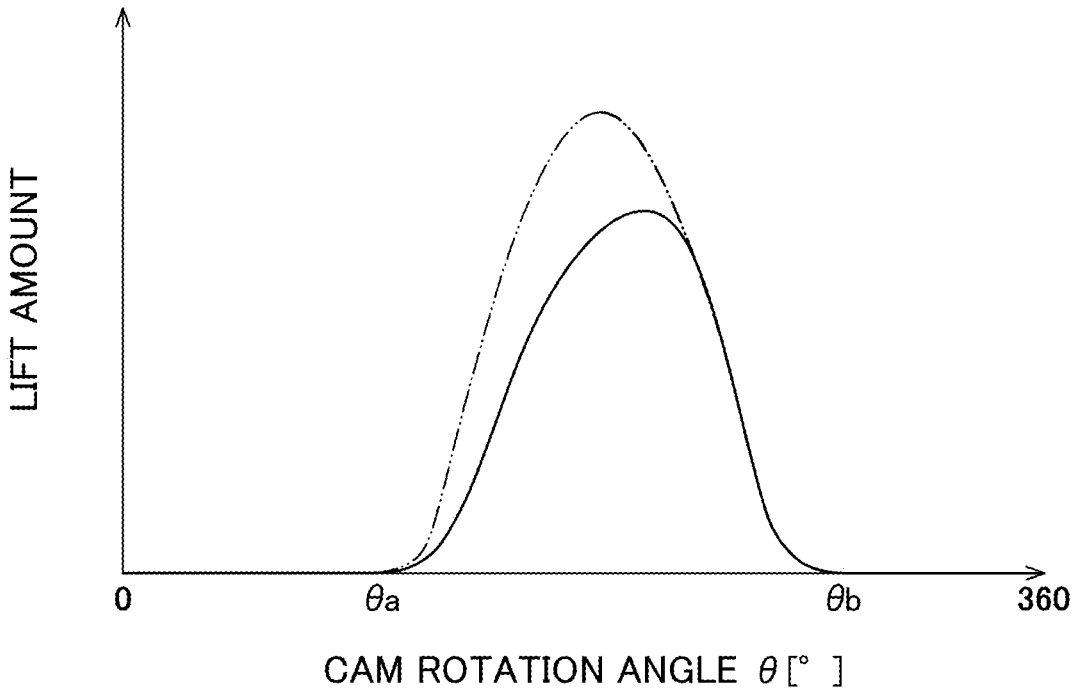
FIG. 5 is a graph showing a relation between a cam rotation angle and a valve lift amount.

FIG. 5 is a graph in which: a horizontal axis represents a rotation angle θ of the cam 21; and a vertical axis represents a lift amount (i.e., a distance from the valve seat 4*a* to the flange portion 11*a*) of the valve 10. In FIG. 5, a solid line shows a relation between the rotation angle θ and the lift amount when the variable valve mechanism 20A is in the low lift state, and a two-dot chain line shows a relation between the rotation angle θ and the lift amount when the variable valve mechanism 20A is in the high lift state.

First, the variable valve mechanism 20A in the low lift state will be described. As shown in FIG. 3A, when the base circle 21*a* of the cam 21 is located at a position opposed to the swinging arm 23, the cam 21 does not push down the swinging arm 23 (see a range of $0° \leq \theta < \theta_a$ and a range of $\theta_b < \theta < 360°$ in FIG. 5). Therefore, the swinging arm 23 does not push down the valve main body 11, and thus, the valve 10 continues to close the port 4. When the base circle 21*a* of the cam 21 is located at the position opposed to the swinging arm 23, the base circle 21*a* does not have to contact the swinging arm 23.

When the cam 21 rotates, and the cam nose 21*b* of the cam 21 starts contacting an upper surface of the swinging arm 23 (see $\theta = \theta_a$ in FIG. 5), the cam 21 pushes down the valve main body 11 through the swinging arm 23, and thus, the flange portion 11*a* separates from the valve seat 4*a* to open the port 4. Then, as the cam 21 rotates, a push-down amount of the tappet 18 by the first end portion 23*a* of the swinging arm 23 gradually increases, i.e., the lift amount of the valve main body 11 gradually increases. After the lift amount has become maximum (see FIG. 3B), the lift amount gradually decreases until the flange portion 11*a* is brought into contact with the valve seat 4*a* (see $\theta = \theta_b$ in FIG. 5). The swinging arm 23 swings while the lift amount of the valve 10 changes. Specifically, a movement range (movement trajectory) of the first end portion 23*a* of the swinging arm 23 is regulated by the regulating arm 25, and the first end portion 23*a* of the swinging arm 23 turns about the axis C4 of the second swinging shaft 26. On the other hand, the second end portion 23*b* of the swinging arm 23 moves in accordance with the movement of the first end portion 23*a* of the swinging arm 23 while making the engaging pin 41 slide in the insertion hole 34.

Next, the variable valve mechanism 20A in the high lift state will be described. In the high lift state shown in FIGS. 4A and 4B, the connection member 33 is located at a position closer to the cam 21 than that in the low lift state shown in FIGS. 3A and 3B.

The operation of the variable valve mechanism 20A in the high lift state is the same as that in the low lift state. To be specific, as shown in FIG. 4A, when the base circle 21*a* of the cam 21 is located at the position opposed to the swinging arm 23, the cam 21 does not push down the swinging arm 23 (see the range of $0° \leq \theta < \theta_a$ and the range of $\theta_b < \theta < 360°$ in FIG. 5). To be specific, the valve 10 continues to close the port 4.

When the cam 21 rotates, and the cam nose 21*b* of the cam 21 starts contacting the upper surface of the swinging arm 23 (see θ=θa in FIG. 5), the cam 21 pushes down the valve main body 11 through the swinging arm 23, and thus, the flange portion 11*a* separates from the valve seat 4*a* to open the port 4. Then, as the cam 21 rotates, the push-down amount of the tappet 18 by the first end portion 23*a* of the swinging arm 23 gradually increases, i.e., the lift amount of the valve main body 11 gradually increases. After the lift amount has become maximum (see FIG. 4B), the lift amount gradually decreases until the flange portion 11*a* is brought into contact with the valve seat 4*a* (see θ=θb in FIG. 5). The swinging arm 23 swings while the lift amount of the valve 10 changes. Specifically, the movement range (movement trajectory) of the first end portion 23*a* of the swinging arm 23 is regulated by the regulating arm 25, and the first end portion 23*a* of the swinging arm 23 turns about the axis C4 of the second swinging shaft 26. On the other hand, the second end portion 23*b* of the swinging arm 23 moves in accordance with the movement of the first end portion 23*a* of the swinging arm 23 while making the engaging pin 41 slide in the insertion hole 34.

Next, the displacement of the swinging arm 23 in the variable valve mechanism 20A by a change in the lift characteristics of the valve 10 will be described. To change the state of the variable valve mechanism 20A from the low lift state to the high lift state, the moving device 31 moves the connection member 33 close to the cam 21. The swinging arm 23 swings while the connection member 33 moves. Specifically, the movement range (movement trajectory) of the first end portion 23*a* of the swinging arm 23 is regulated by the regulating arm 25. On the other hand, the second end portion 23*b* of the swinging arm 23 is moved in a moving direction (upward) by the moving device 31 so as to turn about the axis C3 of the first swinging shaft 24 while making the engaging pin 41 slide in the insertion hole 34.

As described above, according to the variable valve mechanism 20A of the present embodiment, when the second end portion 23*b* of the swinging arm 23 is moved by the moving device 31, the regulating arm 25 regulates the displacement of the first end portion 23*a* of the swinging arm 23 relative to the valve 10. Moreover, the connection member 33 connects the second end portion 23*b* of the swinging arm 23 to the moving device 31 such that when the second end portion 23*b* of the swinging arm 23 is moved by the moving device 31, the movement of the second end portion 23*b* of the swinging arm 23 about the first swinging shaft 24 is allowed. Therefore, the displacement of the first end portion 23*a* of the swinging arm 23 relative to the valve 10 can be suppressed at the time of the movement of the swinging arm 23 by the change in the lift characteristics.

Moreover, in the present embodiment, when the second end portion 23*b* of the swinging arm 23 is moved by the moving device 31, the second end portion 23*b* of the swinging arm 23 moves about the first swinging shaft 24 while making the engaging pin 41 slide in the longitudinal direction of the insertion hole 34. Therefore, the movement of the second end portion 23*b* of the swinging arm 23 when moving the swinging arm 23 in order to change the lift characteristics can be regulated to the longitudinal direction of the insertion hole 34.

Moreover, in the present embodiment, each of the curvature radiuses of the first outer peripheral surface portion 41*a* and the second outer peripheral surface portion 41*b* of the engaging pin 41 contacting the inner peripheral surface of the insertion hole 34 when viewed from a direction in which the camshaft 22 as the rotating shaft of the cam 21 extends is larger than the length that is half the width w of the insertion hole 34 in the transverse direction. Therefore, the contact surface pressure between the engaging pin 41 and the insertion hole 34 when moving the swinging arm 23 in order to change the lift characteristics can be reduced.

Moreover, in the present embodiment, the second end portion 25*b* of the regulating arm 25 is supported so as to be rotatable about the second swinging shaft 26 disposed at a fixed position with respect to the axis C1 of the camshaft 22. Therefore, the displacement of the first end portion 23*a* of the swinging arm 23 relative to the valve 10 can be regulated by a simple configuration.

Embodiment 2

Figure 6:
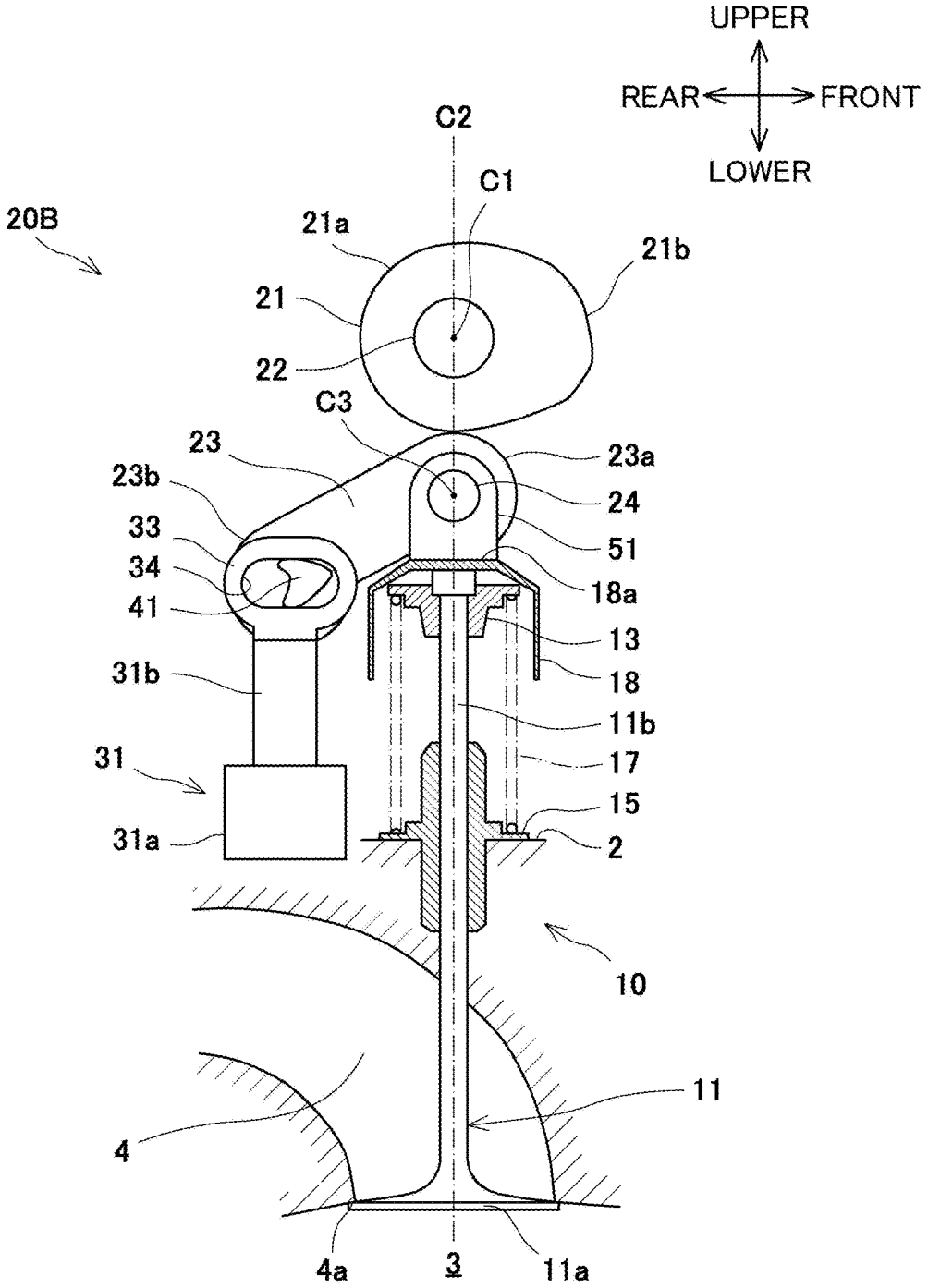
FIG. 6 is a schematic sectional view showing the variable valve mechanism of the engine according to Embodiment 2 and its vicinity.

Next, a variable valve mechanism 20B according to Embodiment 2 will be described with reference to FIG. 6. FIG. 6 is a schematic sectional view showing the intake-side variable valve mechanism 20B of the engine according to Embodiment 2 and its vicinity. In the variable valve mechanism 20B of the present embodiment, the displacement of the first end portion 23*a* of the swinging arm 23 relative to the valve 10 is regulated by a regulating member 51 disposed at an upper end portion of the valve 10 instead of the regulating arm 25 supported by the rotation supporting portion 27.

The regulating member 51 is connected to the valve 10. In the present embodiment, the regulating member 51 is fixed to the upper surface 18*a* of the tappet 18. The first end portion 23*a* of the swinging arm 23 and the regulating member 51 are coupled to each other so as to be rotatable relative to each other by the first swinging shaft 24 extending in parallel with the axis C1 of the camshaft 22. For example, when viewed from the direction along the axis C1, the first swinging shaft 24 is arranged on the axis C2 of the valve 10. However, when viewed from the direction along the axis C1, the first swinging shaft 24 does not have to be located on the axis C2 of the valve 10 and may be located in front of or behind the axis C2 of the valve 10.

The cam 21 is in contact with the upper surface of the first end portion 23*a* of the swinging arm 23, but the upper surface 18*a* of the tappet 18 is not in contact with the lower surface of the first end portion 23*a* of the swinging arm 23. Therefore, when the swinging arm 23 is pushed by the cam 21, the swinging arm 23 pushes the valve 10 through the regulating member 51.

The tappet 18 and the regulating member 51 may be formed integrally or may be formed separately. Moreover, instead of the tappet 18, the regulating member 51 may be connected to the upper end portion of the stem portion 11*b* directly or through a member different from the tappet 18. Furthermore, the regulating member 51 and the upper end portion of the stem portion 11*b* may be coupled to each other so as to be rotatable relative to each other by the first swinging shaft 24 extending in parallel with the axis C1 of the camshaft 22.

The present embodiment can obtain the same effects as Embodiment 1. Moreover, in the present embodiment, since the regulating member 51 is connected to the valve 10, the displacement of the first end portion 23*a* of the swinging arm 23 relative to the valve 10 can be further suppressed.

Embodiment 3

Figure 7:
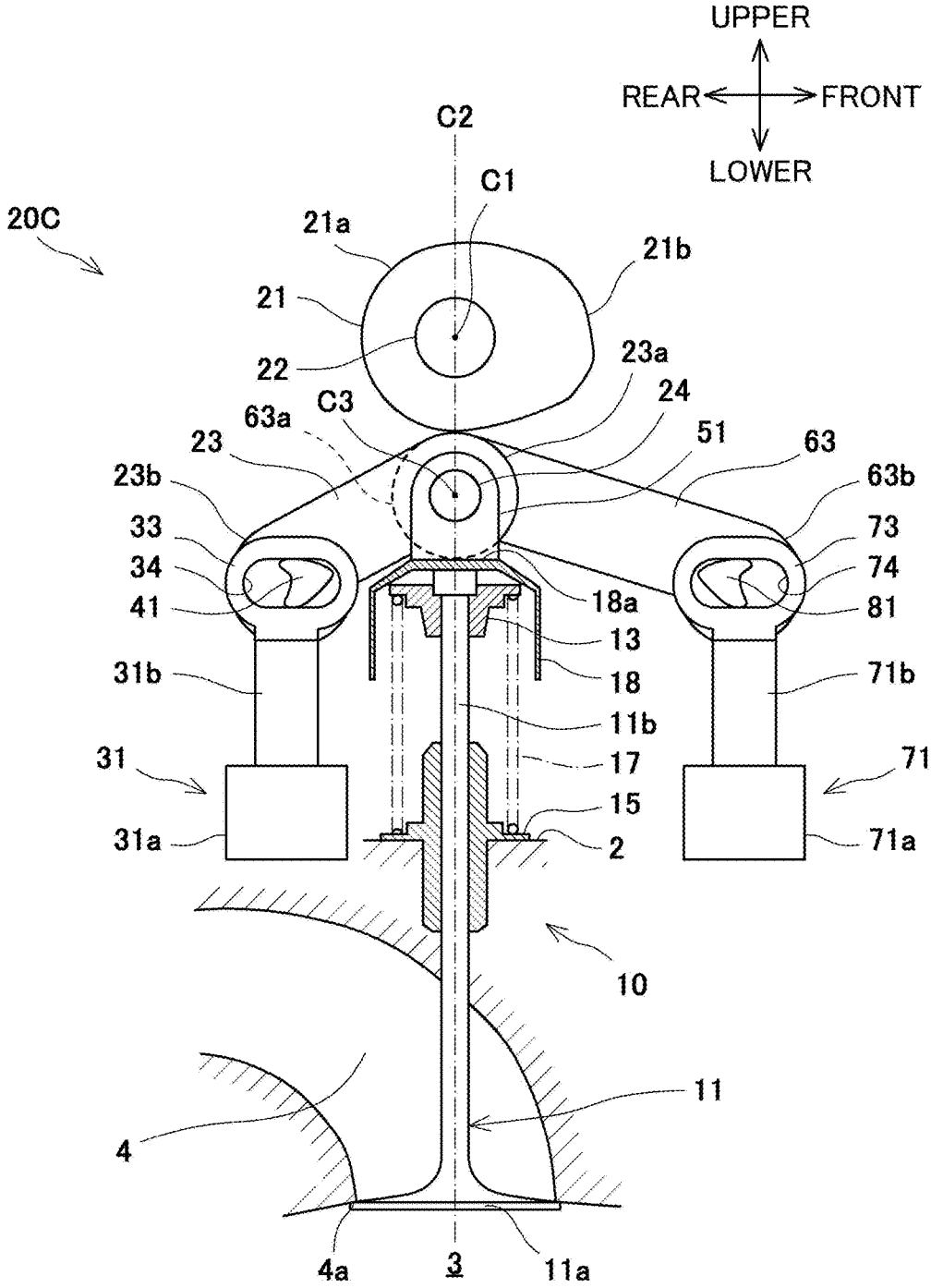
FIG. 7 is a schematic sectional view showing the variable valve mechanism of the engine according to Embodiment 3 and its vicinity.

Next, a variable valve mechanism 20C according to Embodiment 3 will be described with reference to FIG. 7. FIG. 7 is a schematic sectional view showing the intake-side variable valve mechanism 20C of the engine according to Embodiment 3 and its vicinity. As with Embodiment 2, the variable valve mechanism 20C of the present embodiment includes the regulating member 51 connected to the valve 10. The variable valve mechanism 20C of the present embodiment further includes a swinging arm 63, a moving device 71, and a connection member 73 which are different from the swinging arm 23, the moving device 31, and the connection member 33.

In the present embodiment, the swinging arm 23, the moving device 31, and the connection member 33 are respectively referred to as a first swinging arm 23, a first moving device 31, and a first connection member 33, and the swinging arm 63, the moving device 71, and the connection member 73 are respectively referred to as a second swinging arm 63, a second moving device 71, and a second connection member 73.

The second moving device 71 and the second connection member 73 are located in front of the axis C2 of the valve 10. The second swinging arm 63, the second moving device 71, and the second connection member 73 are substantially the same in structure as the first swinging arm 23, the first moving device 31, and the first connection member 33 described in the above embodiment, respectively. More specifically, the second swinging arm 63, the second moving device 71, and the second connection member 73 are substantially symmetrical to the first swinging arm 23, the first moving device 31, and the first connection member 33 across a predetermined plane perpendicular to the front-rear direction.

To be specific, the second swinging arm 63 is disposed between the cam 21 and the valve 10. A first end portion 63*a* of the second swinging arm 63 is coupled to the regulating member 51 so as to be rotatable about the first swinging shaft 24. The cam 21 is in contact with an upper surface of the first end portion 63*a* of the second swinging arm 63, but the upper surface 18*a* of the tappet 18 is not in contact with a lower surface of the first end portion 63*a* of the second swinging arm 63. As with the first swinging arm 23, the second swinging arm 63 is pushed by the rotating cam 21 to swing and push the valve 10 through the regulating member 51.

The second moving device 71 moves a second end portion 63*b* of the second swinging arm 63. The second moving device 71 is the same in configuration as the first moving device 31. The second moving device 71 includes: a fixed member 71*a* disposed at a fixed position with respect to the axis C1 of the camshaft 22; and a movable portion 71*b* that is movable (displaceable) relative to the fixed member 71*a*. The second moving device 71 may be the same in configuration as the first moving device 31 or may be different in configuration from the first moving device 31. For example, the first moving device 31 is a linear motion actuator, and the second moving device 71 may be a turning actuator.

The second connection member 73 connects the second end portion 63*b* of the second swinging arm 63 to the second moving device 71 such that when the second end portion 63*b* of the second swinging arm 63 is moved by the second moving device 71, the movement of the second end portion 63*b* of the second swinging arm 63 about the first swinging shaft 24 is allowed.

An engaging pin 81 is disposed at the second end portion 63*b* of the second swinging arm 63. The second connection member 73 includes an insertion hole 74 into which the engaging pin 81 is inserted. Since the engaging pin 81 and the insertion hole 74 are respectively the same in configuration as the engaging pin 41 and the insertion hole 34, explanations thereof are omitted.

The present embodiment can obtain the same effects as Embodiment 2. Moreover, in the present embodiment, the valve 10 can be pushed down by not only the first swinging arm 23 but also the second swinging arm 63, and the position of the second end portion 63*b* of the second swinging arm 63 can be changed by the second moving device 71. Therefore, the degree of freedom of the change of the lift characteristics of the valve 10 can be improved.

OTHER EMBODIMENTS

The present invention is not limited to the above-described embodiments, and various modifications may be made within the scope of the present invention.

For example, the above embodiments mainly describes the intake-side variable valve mechanism. However, the present invention is also applicable to the exhaust-side variable valve mechanism. In this case, regarding the concept of directions mentioned in the above embodiments, "front" and "rear" may be respectively read as "rear" and "front."

Moreover, the embodiments describe the DOHC engine. However, the present invention is also applicable to other engines, such as a single overhead camshaft (SOHC) engine.

Moreover, in the above embodiments, the engaging pin is disposed at the end portion of the swinging arm, and the insertion hole is disposed at the connection member. However, in the present invention, the engaging pin may be disposed at the connection member, and the insertion hole may be disposed at the end portion of the swinging arm. Moreover, the shape of the engaging pin is not limited to the above embodiments. For example, when viewed from the direction in which the axis C1 of the camshaft 22 extends, the outer peripheral surface of the engaging pin may have a circular shape having a diameter that is equal to the width w of the insertion hole 34 in the transverse direction. Furthermore, the insertion hole 34 does not have to be long in a direction orthogonal to the valve axis C2 and may be long in a direction oblique to the direction orthogonal to the valve axis C2.

In the above embodiment, by inserting the engaging pin 41 into the insertion hole 34, the connection member 33 connects the second end portion 23*b* of the swinging arm 23 to the moving device 31. However, the configuration of the connection member of the present invention is not limited to this. To be specific, the connection member of the present invention may have any configuration as long as the connection member connects the second end portion 23*b* of the swinging arm 23 to the moving device 31 such that when the second end portion 23*b* of the swinging arm 23 is moved by the moving device 31, the movement of the second end portion 23*b* of the swinging arm 23 about the first swinging shaft 24 is allowed.

The invention claimed is:

1. A variable valve mechanism that changes a lift characteristic of a gas exchange valve of an engine, the variable valve mechanism comprising:

a cam fixed to a camshaft configured to rotate in association with rotation of a crank shaft of the engine;

a swinging arm disposed between the cam and the valve, the swinging arm including a first end portion and a second end portion, the first end portion configured to be actuated via the cam so as to open the valve;

a mover configured to move the second end portion;

a regulator pivotally coupled to the first end portion via a swinging shaft extending parallel to the camshaft, the regulator configured to regulate a lateral displacement of the first end portion relative to the valve when the second end portion is moved via the mover; and a connector configured to pivotally connect the second end portion to the mover so as to enable the swinging arm to pivot about the swinging shaft when the second end portion is moved via the mover.

2. The variable valve mechanism according to claim 1, wherein the connector includes:

an engaging pin disposed at one of the second end portion and the mover, the engaging pin extending parallel to the camshaft, and an insertion hole disposed at a remaining one of the second end portion and the mover, the insertion hole including an elongated hole shape extending perpendicular to the engaging pin so as to slidably receive the engaging pin, and wherein the swinging arm pivots about the swinging shaft and the engaging pin slides along the insertion hole when the second end portion is moved by the mover.

3. The variable valve mechanism according to claim 2, wherein an outer peripheral surface portion of the engaging pin slidably engages an inner peripheral surface of the insertion hole, and wherein the outer peripheral surface portion includes a radius of curvature that is greater than half of a transverse width of the insertion hole.

4. The variable valve mechanism according to claim 1, wherein the regulator comprises:

a rotation supporting portion disposed at a fixed position with respect to the camshaft, and a regulating arm including a first regulating end portion pivotally coupled to the first end portion of the swinging arm via the swinging shaft, and a second regulating end portion pivotally coupled to the rotation supporting portion via a second swinging shaft extending parallel to the camshaft.

5. The variable valve mechanism according to claim 1, wherein:

the regulator is fixed to the valve, and the swinging arm opens the valve via the regulator.

6. The variable valve mechanism according to claim 5, further comprising:

a second swinging arm disposed between the cam and the valve, the second swinging arm including a first end portion and a second end portion, the first end portion of the second swinging arm pivotally coupled to the regulator via the swinging shaft, the first end portion of the second swinging arm configured to be actuated via the cam so as to open the valve via the regulator;

a second mover configured to move the second end portion of the second swinging arm, and a second connector configured to pivotally connect the second end portion of the second swinging arm to the second mover so as to enable the second swinging arm to pivot about the swinging shaft when the second end portion of the second swinging arm is moved via the second mover.

* * * * *